362-113 SR
7/24/79 OR 4,162,521

United States Patent [19]

Snyder

[11] 4,162,521

[45] Jul. 24, 1979

[54] CONTROL CIRCUIT ARRANGEMENT FOR LASER AIMING SYSTEM HAVING MAGNETIC DECOUPLING MEANS

[76] Inventor: Wesley L. Snyder, 1103 Forest Home Dr., Houston, Tex. 77094

[21] Appl. No.: 826,562

[22] Filed: Aug. 22, 1977

[51] Int. Cl.[2] ..... F41G 1/34

[52] U.S. Cl. ..... 362/113; 361/10; 362/259

[58] Field of Search ..... 361/10, 11; 200/157; 362/110, 111, 112, 113, 114, 259; 42/1 A

[56] References Cited

U.S. PATENT DOCUMENTS

| | | | |
|---|---|---|---|
| 3,334,208 | 8/1967 | Green | 200/157 |
| 3,697,774 | 10/1972 | Pascente | 361/10 |
| 4,026,054 | 5/1977 | Snyder | 42/1 A |
| 4,048,489 | 9/1977 | Giannetti | 362/259 |

*Primary Examiner*—Stephen C. Bentley
*Attorney, Agent, or Firm*—Arnold, White & Durkee

[57] ABSTRACT

A control circuit arrangement for a laser aiming system for aiming a weapon or firearm is characterized by a laser head operable to generate a coherent beam of light energy useful to assist in aiming a weapon. The laser head includes a high voltage power supply having positive and negative terminals thereon. A source of D.C. electrical potential is connected to the first and second terminals. Magnetically responsive reed switches are serially connected between the source and each of the positive and negative terminals. An inductor is connected in series intermediate each of the magnetically responsive switches and the terminals to magnetically decouple the switches from the high voltage power supply and limit the intensity of magnetic fields induced by switching transient signals from the high voltage power supply.

9 Claims, 1 Drawing Figure

CONTROL CIRCUIT ARRANGEMENT FOR LASER AIMING SYSTEM HAVING MAGNETIC DECOUPLING MEANS

BACKGROUND OF THE INVENTION

1. Field of the Invention

This invention relates to laser aiming systems for assisting the aiming of firearms, and in particular, to a control circuit arrangement for a laser aiming system.

2. Description of the Prior Art

Laser assisted aiming systems for weapons are known in the art. For example, U.S. Pat. No. 4,026,054, issued to the inventor of the instant invention, discloses and claims a laser aiming system including a self-contained power supply module and laser tube. Further, application Ser. No. 717,349, filed Aug. 24, 1976, now U.S. Pat. No. 4,079,534, in the name of the inventor of the instant invention relates to a laser sighting apparatus for interchangeably attaching laser aiming devices to weapons.

The circuit arrangements utilized in the aiming devices of the above-referenced patent and application utilize a source of electrical potential, typically a D.C. battery, connected in series to a high voltage power supply element. The power supply converts the D.C. signal from the battery to a high voltage, low current signal which is impressed across a coherent light beam generating tube, or laser head. In addition to a manually operated on-off switch, appropriate governmental regulations require the disposition of safety switches in each of the leads connecting the battery to the high voltage supply. Magnetically responsive reed switches have been found to be of particular utility for such safety switches.

As is known by those skilled in the art, a reed switch comprises two overlapping, flat, cantilevered ferromagnetic reeds sealed in an inert gas environment in a glass envelope. The presence of a magnetic field causes the overlapped ends of the reeds to close a slight air gap defined therebetween to provide current-conducting contact therebetween. In the laser aiming systems of the above-referenced patent application, a permanent magnet is inserted into a suitable aperture provided in the aiming system housing to thereby control the closure of one of the magnetically responsive reed switches. A second permanent magnet is mounted in a predetermined orientation on a trigger-like member and brought into a position where the magnet effects the closure of the second reed switch by a finger movement of a marksman similar to the finger movement by which the trigger of the firearm is depressed. That is, movement of the trigger finger of the marksman mechanically actuates the toggle of the aiming device carrying the second permanent magnet to bring that magnet into proximity to the second reed switch. With the second magnet so positioned the control circuit of the aiming device is completed (assuming the manual on-off switch has been actuated) to initiate the generation of the laser beam to assist the marksman in sighting and aiming the weapon. Continued finger movement of the marksman then, of course, engages and depresses the trigger to fire the weapon.

It has, however, been observed that despite the release of the mechanical toggle and the withdrawal of the second magnet from proximity to the second reed switch the laser beam continues to be generated. This has the deleterious consequence of prematurely draining the battery. Furthermore, in some situations, the exposure of the firing location of the marksman may also be disadvantageous.

The continued contact between the flaps of the reed switch after the removal of the permanent magnet associated therewith is believed to be caused by the presence of switching transient current signals from the high voltage supply riding on D.C. current signals from the battery. These switching transient current signals are believed to induce a magnetic field of sufficient intensity about the current carrying leads, including the flaps of the reed switch, to maintain the switch closed even after the removal of the permanent magnet.

Accordingly, it would be advantageous to provide a control circuit arrangement for a laser aiming system wherein the magnetically responsive reed switches are magnetically decoupled from the high voltage power supply. That is to say, it would be advantageous to provide a control circuit arrangement for a laser aiming device wherein switching transient current signals believed to emanate from the high voltage power supply are reduced so that magnetic fields induced thereby are of an intensity insufficient to maintain the magnetically responsive reed switches in a closed state despite the withdrawal of a permanent magnet actuator associated with the reed switch.

SUMMARY OF THE INVENTION

This invention relates to a control circuit arrangement for a laser aiming system for aiming a weapon or firearm which comprises means for generating a coherent beam of light useful to assist in aiming the weapon, the means including a high voltage power supply having a first and a second terminal thereon, a source of electrical potential connected to the first and second terminals of the power supply and magnetically responsive switches, such as reed switches, disposed in series with each terminal and the source. The control circuit further comprises means for magnetically decoupling the switches from the high voltage power supply to reduce the magnitude of switching transient current signals from the high voltage power supply riding on the D.C. current from the battery to thereby limit the intensity of a magnetic field induced by the transients to an intensity insufficient to maintain the magnetically responsive switches closed. The decoupling means may conveniently comprise an RF choke which is, in effect, an inductor coil connected in series intermediate each of the switches and the associated terminal.

BRIEF DESCRIPTION OF THE DRAWING

The invention will be more fully understood from the following detailed description thereof taken in connection with the accompanying drawing FIGURE, which forms a part of this specification, and which is a schematic diagram of a control circuit arrangement for a laser aiming system for aiming a weapon or firearm and which embodies the teachings of this invention.

DESCRIPTION OF PREFERRED EMBODIMENT

Figure 1:
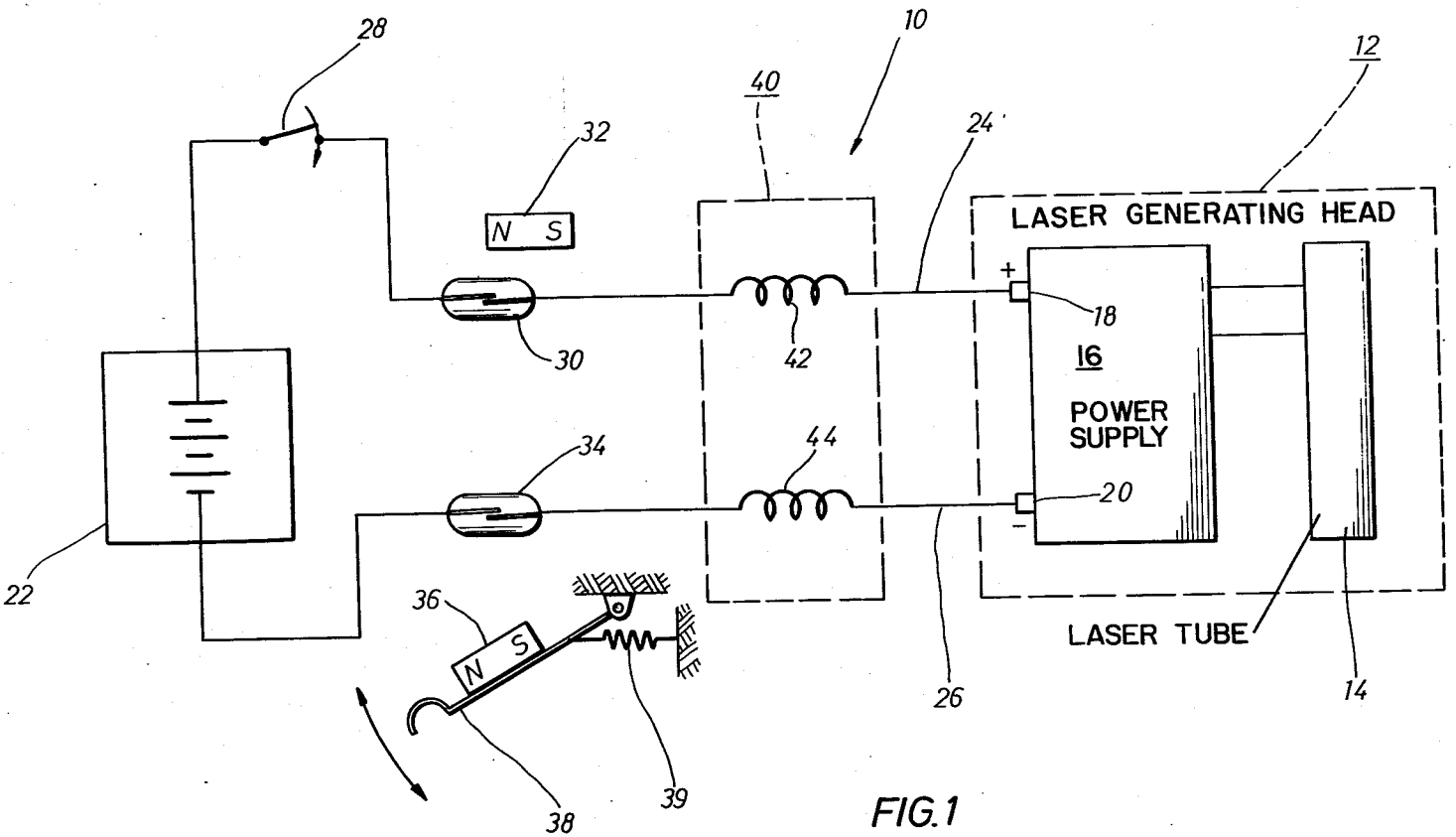

Referring to the FIGURE, shown is a schematic diagram of a control circuit arrangement 10 for a laser aiming system for aiming a weapon or firearm having a magnetic decoupler in accordance with the teachings of this invention. The control circuit arrangement 10 is physically configured so as to be received and accommodated within a suitable housing as described in U.S. Pat. No. 4,026,054 and application Ser. No. 717,349, filed Aug. 24, 1976, now U.S. Pat. No. 4,079,534, both the inventions being made by the inventor of the invention disclosed and claimed in the instant application.

As seen in the FIGURE, the control circuit arrangement 10 includes means generally indicated by reference numeral 12, such as a laser head, for generating a coherent beam of light energy useful to assist in aiming the firearm. As disclosed in the above-referenced patent and application, the laser head projects therefrom a beam of coherent light onto a target at a given range to indicate the impact point of the projectile able to be fired from the weapon having the aiming arrangement associated therewith. The laser generating head 12 includes a laser tube 14 connected to a high voltage power supply 16. The power supply 16 has a first, positive, terminal 18 and a second. negative, terminal 20 as indicated in the FIGURE.

A source of electrical potential, as a D.C. battery 22, is connected to the first terminal 18 by a line 24 and to the second terminal 20 by line 26. An on-off switch 28 may be conveniently connected at any location within the control circuit arrangement 10. The on-off switch 28 may be a manually operated switch of any suitable type.

The laser tube 14 disposed within the laser beam generating means 12 may be any suitable coherent light beam generating tube such as that manufactured by Coherent Radiation Corporation and sold under Model No. CR084. The high voltage power supply 16 may be any suitable D.C. converter such as that manufactured by Crestronics and sold under Model No. PS254A. The purpose of the power supply 16 is, as appreciated by those skilled in the art, to convert D.C. current supplied by the source of electrical potential 22 to a high voltage, low current signal impressed across the laser tube 14 to generate the coherent light beam therefrom.

Connected serially within the line 24 between the source of electrical potential 22 and the positive terminal 18 is a first magnetically responsive reed switch 30, such as that manufactured by Tandy Corporation and sold under Model No. 275-034. The cantilevered flaps of the reed switch 30 are held in a closed condition when a permanent magnet 32 is received with an aperture provided in the control circuit housing proximal to the reed switch 30. Disposed serially in the line 26 connecting the source of electrical potential 22 with the second, negative, terminal 20 is a second magnetically responsive reed switch 34. The switch 34 is identical to the switch 30 connected in the line 24. The reed switch 34 has associated therewith a permanent magnet 36 which is adapted for movement on a suitable pivotal support, indicated diagramatically at reference number 38. As discussed in the above-referenced patent and application, manual movement of the support 38 draws the permanent magnet 36 into a location proximal to the second reed switch 34 during the movement of a marksman or weapons operator preparatory to the firing of the weapon to thereby complete all circuit connections within the control circuitry 10 (assuming the on-off switch 28 has been actuated) so that the laser beam generating means 12 may generate a coherent light beam on a selected target. That is to say, with substantially the same finger movement of the marksman or weapons operator used to depress the trigger and discharge the weapon, the support 38 is moveable to bring the permanent magnet 36 into proximity with the reed switch 34 to thereby close all circuit connections within the control circuit 10 and initiate the generation of a coherent light beam. With the beam eliminating a selected impact point on a target to assist in aiming the weapon, the weapon may then be discharged.

The support 38 is usually spring loaded, as by a spring 39, so that upon the release of the trigger and support 38 the permanent 36 is removed from proximity to the reed switch 34 to again place the reed switch 34 in the open state. However, it has been observed that the movement of the permanent magnet 36 out of proximity with the reed switch 34 does not, in all cases, open the switch 34 and cease actuation of the laser beam generated by the means 12. The leads 24 and 26 are believed to carry switching transients current signals from the high voltage source 16 (generated by the internal switching operations within the supply 16) riding on the D.C. current from the battery 22. It is believed that the switching transient current signals induce a magnetic field of sufficient intensity about the lines 24 and 26 to hold the cantilevered elements of the reed switch 34 closed even after the removal of the permanent magnet 36. Stated alternatively, high frequency transient current signals generated by switching operations within the power supply 16 are carried by the connected leads 24 and 26 and induce a magnetic field about these current paths, which include the closed flaps of the reed switch 34. The intensity of the magnetic field induced by the transients are sufficient to hold the flaps of the reed switch 34 in a closed condition even after the removal of the permanent magnet 36 from proximity thereto.

In order to magnetically decouple the reed switches 30 and 34 (which are connected in series with each terminal 18 and 20 respectively, and the electrical potential source 22) from the high voltage power supply 16, means 40 for magnetically decoupling the switches 30 and 34 are provided. The means 40 include RF chokes or inductor coils 42 and 44, respectively connected in series intermediate between the reed switch 30 and positive terminal 18 and intermediate between the reed switch 34 and the negative terminal 20. The inductors 42 and 44 act generally analogously to a radio frequency choke which, as it is known to those skilled in the art, are coils designed to have high inductive reactances at radio frequencies and are used to reduce or prevent currents at these frequencies from passing from one circuit to another. The presence of the inductors 42 and 44 in the series connections shown in the FIGURE alters the impedance of the circuit 10 at high frequency and thereby acts to limit the magnitude of the feedback currents generated by transients from the high voltage source 16. With the transient currents so reduced by the inductors 42 and 44, the intensity of the magnetic field induced in the conductors 24 and 26 is thereby commensurately lessened. Accordingly, magnetic inductive effects which tend to maintain the reed switch 34 closed even after the withdrawal of the associated permanent magnet 36 therefrom are sufficiently reduced. Thus, for example, the cantilevered flaps of the reed switch 34, when closed and part of the electrical circuit, are not surrounded by an induced magnetic field of an intensity sufficient to hold the flaps of the reed switch 34 in contact one with the other after the withdrawal of the permanent magnet 36 from proximity thereto. Suitable decoupling means 40 include radio frequency chokes 42 and 44 manufactured by Tandy Corporation and sold under Model No. 273-102. In this way, the reed switches 30 and 34 may be magnetically decoupled from the power supply 16 to avoid the consequences of magnetic fields induced by transient current signals generated by switching of the power supply 16, as set out above.

Having described a preferred embodiment of the invention, those skilled in the art may effect numerous modifications thereto in view of the teachings hereinabove set forth. However, it is understood that such modification are within the contemplation of this invention and fall within the scope of the appended claims.

What is claimed is:

1. A control circuit arrangement for a laser aiming system for aiming a firearm comprising:

means for generating a coherent beam of light useful to assist in aiming a firearm, said means including a high voltage power supply having first and second terminals;

a source of electrical potential connected to said first and second terminals;

first and second magnetically responsive switches respectively disposed in series with each of said first and second terminals and said source; and, means for magnetically decoupling said high voltage power supply from said magnetically responsive switches, said means for magnetically decoupling being substantially resistanceless.

2. The control circuit arrangement of claim 1 wherein said decoupling means comprises an inductor coil connected in series intermediate each of said magnetically responsive switches and said terminals of said high voltage power supply.

3. The control circuit arrangement of claim 2 wherein said magnetically responsive switches each comprise a reed switch.

4. The control circuit arrangement of claim 1 wherein said magnetically responsive switches each comprise a reed switch.

5. A control circuit for a laser aiming system comprising:

a laser for projecting a coherent beam of light onto a target;

a high voltage power supply including first and second terminals connected to and operatively associated with said laser;

a battery connected to said first and second terminals;

a first magnetically responsive switch connected between said battery and said first terminal;

a second magnetically responsive switch connected between said battery and said second terminal; and, means for magnetically decoupling said high voltage power supply from said first and second magnetically responsive switches, said means for magnetically decoupling being substantially resistanceless.

6. A circuit as set forth in claim 5 further including an electromechanical switch for circuit connection to said battery.

7. A control circuit as set forth in claim 5 further including a permanent magnet switch for closing one of said first and second magnetically responsive switches.

8. A control circuit as set forth in claim 7 wherein said permanent magnet switch comprises a trigger mechanism having a permanent magnet attached thereto, and elastically connected to said weapon.

9. A control circuit for a laser aiming system comprising:

a laser for projecting a coherent beam of light onto a target;

a high voltage power supply including first and second terminals connected to and operatively associated with said laser;

a DC power source connected to said first and second terminals;

a first magnetically responsive switch connected between said DC power source and said first terminal;

a second magnetically responsive switch connected between said DC power source and said second terminal; and, an inductor for magnetically decoupling said high voltage power supply from said first and second magnetically responsive switches, said inductor being substantially resistanceless.

* * * * *

UNITED STATES PATENT OFFICE

CERTIFICATE OF CORRECTION

Patent No. 4,162,521 Dated July 24, 1979

Inventor(s) Wesley L. Snyder

It is certified that error appears in the above-identified patent and that said Letters Patent are hereby corrected as shown below:

In Column 3, Line 9, omit the word "and".

In Column 3, Line 52, "diagramatically" should be --diagrammatically--.

In Column 3, Line 53, omit the word "and".

In Column 3, Line 65, "moveable" should be --movable--.

In Column 5, Line 7, "modification" should be --modifications--.

Signed and Sealed this

*Thirteenth* Day of *November 1979*

[SEAL]

*Attest:*

RUTH C. MASON
*Attesting Officer*

LUTRELLE F. PARKER
*Acting Commissioner of Patents and Trademarks*